United States Patent [19]

Shannon

[11] Patent Number: 4,605,222

[45] Date of Patent: Aug. 12, 1986

[54] WEIGHTLIFTING EXERCISE BAR

[76] Inventor: Gary L. Shannon, 637 Brooks, Pontiac, Mich. 48055

[21] Appl. No.: 661,107

[22] Filed: Oct. 15, 1984

[51] Int. Cl.[4] ..... A63B 11/02; A63B 13/00

[52] U.S. Cl. ..... 272/122; 272/123

[58] Field of Search ..... 272/122, 123, 117, 124

[56] References Cited

U.S. PATENT DOCUMENTS

| | | | |
|---|---|---|---|
| 2,508,567 | 5/1950 | Dymeck | 272/123 |
| 2,722,419 | 11/1955 | Tarapczynski | 272/123 |
| 4,274,628 | 6/1981 | Hoagland | 272/123 |
| 4,312,506 | 1/1982 | Brennan | 272/123 |

FOREIGN PATENT DOCUMENTS

| | | | |
|---|---|---|---|
| 3696 | of 1900 | United Kingdom | 272/122 |

*Primary Examiner*—Richard J. Johnson

*Attorney, Agent, or Firm*—Harness, Dickey & Pierce

[57] ABSTRACT

An improved weightlifting exercise bar is described particularly useful for use by body builders and power lifters in physical development. The unique bar shape features a center section with a pair of handles extending therefrom at substantially 90 degrees. The handle sections terminate in ends which are angled with respect to the handles at an angle less than 90 degrees such that the ends are angled toward the longitudinal axis of the center section. The entire bar preferably is bent such that it lies in a single plane. This configuration provides a combined bar with weight plates that enables a user to grasp the handles without a resultant torque being imposed on the user's wrists. The bar is described in connection with a number of exercises which can be conducted with greater effect due to the orientation of the handle portions of the bar and the clearance which the bar provides with the user's body.

17 Claims, 5 Drawing Figures

WEIGHTLIFTING EXERCISE BAR

BACKGROUND AND SUMMARY OF THE INVENTION

This invention relates to a weightlifting bar and particularly to one useful in enabling a number of weightlifting exercises to be conducted using weighted plates attached to the bar.

Numerous types of weightlifting bars are currently used by body builders and power lifters in order to increase skeletal muscle mass and increase their strength. The most prevalent type of exercise bars are the conventional barbells and dumbbells. These metal bars are formed from straight pieces of hollow tube or solid bar stock which have ends adapted to attach standard weight plates and fastening collars. Although these exercise bars have many uses, they do have limitations. These bars do not adequately exercise certain muscle groups and interfere with a full range of motion during certain exercises. To overcome the disadvantages of conventional straight bars, a number of specialty weightlifting bars have been previously designed and marketed. One type of modified bar is the so-called curling bar. This bar resembles a conventional barbell except that portions of the bar are bent so that the user's hands grasp the bar at an angle with respect to the remainder of the bar. Another type of specialty barbell is in the form of an enclosed oblong center section having two or more center bars and end bars to which weights are attached. This bar overcomes some of the disadvantages of conventional barbells for certain exercises by providing a more optimal hand grip position. Even these modified bar designs, however, impose limitations in the range of motion for certain exercises and are unsuitable for a large number of different types of exercise movements.

In accordance with this invention, an improved weightlifting exercise bar is provided which overcomes many of the disadvantages of prior art bar designs. The improved exercise bar is adapted for a large number of types of exercises and provides a large range of motion in conducting these exercises. An extended range of motion is particularly desirable since it significantly enhances skeletal muscle mass development and strength. The improved exercise bar according to this invention is further very inexpensive to construct since it is formed from a single piece of formed tube or bar stock. This unitary structure improves reliability since the risk of parts becoming detached or welds failing is eliminated. The improved exercise bar according to this invention employs conventional weight plates and collars. The improved exercise bar enables grasping of the bar without exerting undesirable torque loading on the user's wrists. Further, the bar, due to its shape, will not roll from the user when it is placed on a hard flat surface, unlike conventional bars. Finally, due to the unique configuration of this exercise bar, a variety of exercises can be conducted with one bar which are not possible using prior art bar designs.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
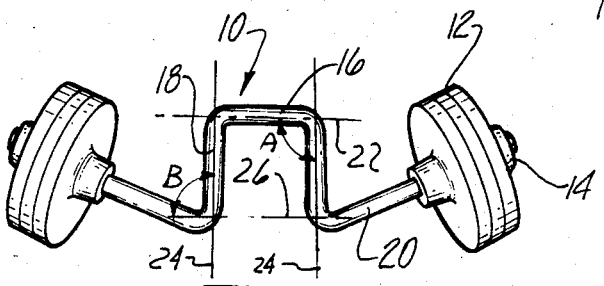
FIG. 1 is a pictorial view of an improved weightlifting exercise bar according to this invention shown with a plurality of weight plates and collars attached thereto.

An improved weightlifting exercise bar according to this invention is shown in FIG. 1 and is generally designated there by reference character 10. Bar 10 is shown with a plurality of conventional weight plates 12 attached to the bar using collars 14. Bar 10 is characterized as having a center section 16 which terminates in a pair of handle portions 18 which extend from the center section at approximately a 90 degree relative angle. This angle is designed in FIG. 1 by reference character A. Center section 16 has a length between 5 and 15 inches and preferably about 10 inches. Each of handles 18 are substantially parallel to each other and lie within the same plane. Handle sections 18 should measure in length between 5 and 8 inches and preferably are about 6 inches. Each of the handles 18 terminate in extending end portions 20. The angle formed between ends 20 and handles 18 designated by reference character B is less than 90 degrees such that the ends are angled toward the longitudinal axis 22 of center section 16. In a preferred configuration, angle B between handles 18 and end 20 is about 65 degrees. Ends 20 are dimensional to receive conventional collars 14 and weight plates 12. A portion of ends 20 may feature a flattened surface which engages a locking set screw (not shown) on collars 14 to prevent their rotation.

Bar 10 is preferably formed by bending a single piece of iron bar or tube stock. The surface of bar 10 can be bare metal, plated, plastic coated or painted, as desired. The final configuration of bar 10 is characterized in that the combined assembly has a center of gravity which lies between handle portions 18, both laterally and longitudinally. This region for the center of gravity is shown in FIG. 1 as being bounded by axis 22, the longitudinal axes of handles 18 identified by reference character 24, and a line 26 extending parallel to axis 22 and intersecting the ends of the handles 18. This feature is significant since it enables a user to grasp handles 18 and lift bar 10 without there being a resultant tortional loading exerted on the user's wrists. This feature would not result if ends 20 were offset from center section 16 and extended in a direction parallel with center section 16.

Due to the configuration of bar 10, it will not roll easily once placed on a ground surface. Rolling is prevented since, for certain bar and weight sizes, center section 16 contacts the ground when the bar is rolled. Rolling is also impeded due to the angled positioning of weights 12 with respect to the ground surface. This feature is significant since rolling barbells and dumbbells can cause injury, particularly to a user's or a bystander's feet.

Figure 2:
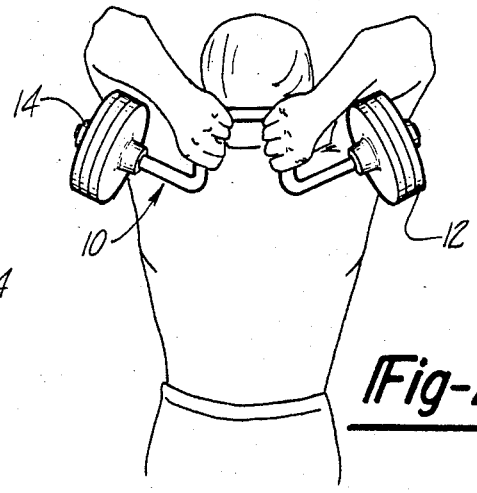
FIG. 2 shows the improved weightlifting exercise bar according to this invention being used in a tricep extension exercise showing the bar and user's arms in an initial position.
Figure 3:
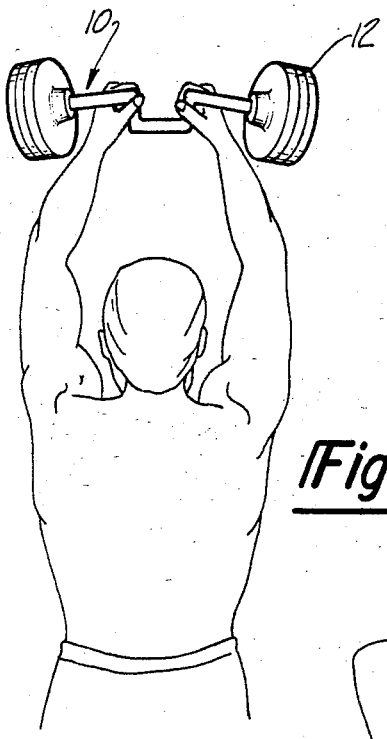
FIG. 3 shows a continuation of the tricep extension exercise shown in FIG. 2 in a second position.

The use of improved weightlifting exercise bar 10 will now be explained in use for various types of exercise movements. FIGS. 2 and 3 illustrate bar 10 being used for a tricep extension exercise. The exercise movement is shown with reference to FIGS. 2 and 3. FIG. 2 illustrates an initial position of the bar with respect to the user. Both hands grasp handles 18 and the bar is placed behind the user's head. The bar is thereafter raised along an arc over the user's head to the position shown in FIG. 3. The positioning and orientation of handles 18 is ideal for the tricep extension exercise since they are positioned to be grasped in a normal relaxed position of the wrist. Further, due to the configuration of bar 10, there is no interference with the user's arms as the hands grasp the handle portions. The bar opening formed between ends 20 prevents contact with the user when the bar is in the position shown by FIG. 2. The angle between handle 18 and ends 20 position weights 12 away from interface with the user's back. As the bar is lifted over the user's head, there is no resultant torque load being imposed on the user's wrist due to the center of gravity placement described previously. Use of a conventional barbell for this exercise results in an undesirable grasping angle. The use of the oblong-shaped bar described above is not possible due to interface between the handles and bar. Bar 10 therefore enables this exercise to be conducted in an optimal manner, not possible using conventional bars, due to the hand gripping position and the large range of motion provided.

Figure 4:
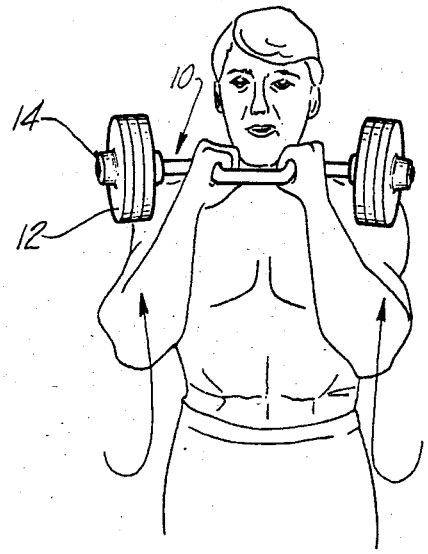
FIG. 4 shows the improved weightlifting exercise bar according to this invention shown being used for a front arm curl exercise.

FIG. 4 shows improved weightlifting exercise bar 10 being used for a front arm curling exercise. FIG. 4 shows bar 10 in a final position and the phantom line arrows show the arc over which the bar is moved for this familiar exercise. One primary advantage of bar 10 for this exercise is the ideal handle orientation which promotes bicep development. Additionally, the configuration of bar 10 enables the bar to be moved much closer to the user's neck in the upper position shown by FIG. 4 since the bar is "cut out" in the center. The angled ends 20 position the weights away from the user's shoulder in the position shown in FIG. 4. These features provide a greater range of motion of the exercise bar throughout this exercise, thereby enhancing physical development.

Figure 5:
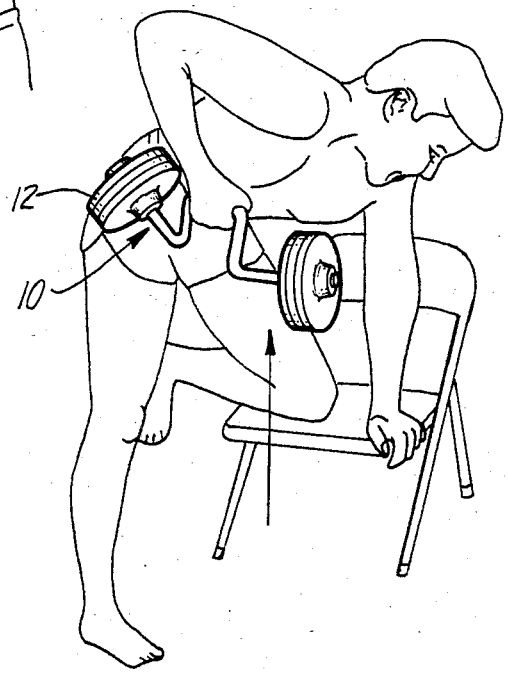
FIG. 5 shows the improved weightlifting exercise bar according to this invention being used for a bent over rowing exercise.

The use of improved weighlifting bar 10 is shown for yet another exercise motion shown in FIG. 5. This figures represents the bent over row type exercise wherein the position of bar 10 is in a final position and the range of motion is illustrated by the phantom line. For this exercise, center section 16 is being grasped by the user. The primary benefit of using bar 10 for this exercise is that weight plates 12 on bar 10 are spread apart further, as compared with a conventional dumbbell thereby providing more body clearance. Use of a conventional barbell is not easily accomplished for this exercise since it is difficult to balance a long bar using one hand. Bar 10, according to this invention, however, has a center of gravity which is below center section 16, thereby aiding in balancing the bar in the hands of the user.

Numerous other exercises beyond those described above can be performed using exercise bar 10. For many of these exercises, bar 10 can be expected to provide benefits and advantages over prior art bar designs due to its unique configuration.

While the above description constitutes the preferred embodiments of the present invention, it will be appreciated that the invention is susceptible to modification, variation and change without departing from the proper scope and fair meaning of the accompanying claims.

What is claimed is:

1. A weightlifting bar adapted to receive weight plates and collars, comprising:

a straight center section, a pair of handle sections extending from said center section, said handle sections being generally parallel to each other and each forming an angle of approximately 90 degrees with respect to said center section, and a pair of straight weight receiving end portions extending from said handle sections and forming an angle therefrom of less than 90 degrees such that said end portions have nonparallel longitudinal axes.

2. The weightlifting bar according to claim 1 wherein said bar center section, handles and end portions each lie within one plane.

3. The weightlifting bar according to claim 1 wherein said bar center section, handles and end portions are formed from a single piece of metal stock.

4. The weightlifting bar according to claim 1 wherein the assembly, including said bar with said weight plates and said collars positioned on said bar such that approximately the same weight is added to each of said end portions of said bar, has a center of gravity located between said handle portions and displaced from said center section.

5. The weightlifting bar according to claim 1 wherein said center section is between 5 and 15 inches in length.

6. The weightlifting bar according to claim 1 wherein said center section is approximately 10 inches in length.

7. The weightlifting bar according to claim 1 wherein each of said handle sections are between 5 and 8 inches in length.

8. The weightlifting bar according to claim 1 wherein each of said handle sections are approximately 6 inches in length.

9. The weightlifting bar according to claim 1 wherein the angle formed between said handle sections and said end portions is approximately 65 degrees.

10. The weightlifting bar according to claim 1 wherein said weightlifting bar is symmetrical with respect to a plane perpendicular to the longitudinal axis of said center section.

11. A weightlifting bar adapted to receive weight plates and collars, comprising:

a straight center section between 5 and 15 inches in length, a pair of handle sections between 5 and 8 inches in length, said handle sections being generally parallel to each other and each forming an angle of approximately 90 degrees with respect to said center section, and a pair of straight weight receiving end portions extending from said handle sections and forming an angle therefrom less than 90 degrees such that said end portions have nonparallel longitudinal axes, said end portions lying in a plane common with said handle sections.

12. The weightlifting bar according to claim 11 wherein said bar center section, handles and end portion are formed from a single piece of metal stock.

13. The weightlifting bar according to claim 11 wherein the assembly, including said bar with said weight plates and said collars positioned on said bar such that approximately the same weight is added to each of said end portions of said bar, has a center of gravity located between said handle portions and displaced from said center section.

14. The weightlifting bar according to claim 11 wherein said center section is approximately 10 inches in length.

15. The weightlifting bar according to claim 11 wherein each of said handle sections are approximately 6 inches in length.

16. The weightlifting bar according to claim 11 wherein the angle formed between said handle sections and said end portions is approximately 65 degrees.

17. The weightlifting bar according to claim 11 wherein said weightlifting bar is symmetrical with respect to a plane perpendicular to the longitudinal axis of said center section.

* * * * *

UNITED STATES PATENT AND TRADEMARK OFFICE

CERTIFICATE OF CORRECTION

PATENT NO. : 4,605,222

DATED : August 12, 1986

INVENTOR(S) : Gary L. Shannon

It is certified that error appears in the above-identified patent and that said Letters Patent is hereby corrected as shown below:

In Column 2, line 29, "designed" should be --designated--.
In Column 3, line 21, "interface" should be --interference--.
In Column 3, line 27, "interface" should be --interference--.
In Column 4, line 67, "portion" should be --portions--.

Signed and Sealed this

Sixteenth Day of December, 1986

*Attest:*

DONALD J. QUIGG

*Attesting Officer* *Commissioner of Patents and Trademarks*